US008970469B2

(12) United States Patent
Nagashima

(10) Patent No.: US 8,970,469 B2
(45) Date of Patent: Mar. 3, 2015

(54) IMAGE DISPLAY APPARATUS WITH A PLURALITY OF DIVIDED LIGHT-EMITTING REGIONS AND METHOD FOR CONTROLLING THEREOF

(75) Inventor: Yoshiyuki Nagashima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 261 days.

(21) Appl. No.: 13/442,447

(22) Filed: Apr. 9, 2012

(65) Prior Publication Data

US 2012/0262434 A1 Oct. 18, 2012

(30) Foreign Application Priority Data

Apr. 12, 2011 (JP) ..... 2011-088427
Feb. 15, 2012 (JP) ..... 2012-030884

(51) Int. Cl.
*G09G 3/36* (2006.01)
*G09G 3/34* (2006.01)

(52) U.S. Cl.
CPC ..... *G09G 3/3611* (2013.01); *G09G 3/3426* (2013.01); *G09G 2320/062* (2013.01); *G09G 2360/141* (2013.01)
USPC ..... 345/102

(58) Field of Classification Search
CPC ..... G09G 3/3426
USPC ..... 345/102
See application file for complete search history.

(56) References Cited

U.S. PATENT DOCUMENTS

| | | | | |
|---|---|---|---|---|
| 2001/0055017 | A1* | 12/2001 | Ording | 345/440 |
| 2006/0049781 | A1* | 3/2006 | Lee et al. | 315/312 |
| 2007/0030697 | A1* | 2/2007 | Kim | 362/618 |
| 2007/0176885 | A1* | 8/2007 | Jun | 345/102 |
| 2008/0112164 | A1* | 5/2008 | Teshirogi | 362/231 |
| 2008/0238341 | A1* | 10/2008 | Korcharz et al. | 315/297 |
| 2008/0238860 | A1* | 10/2008 | Onodera | 345/102 |
| 2008/0245949 | A1* | 10/2008 | Morimoto et al. | 250/205 |
| 2008/0278432 | A1* | 11/2008 | Ohshima | 345/102 |
| 2009/0167674 | A1* | 7/2009 | Katsu | 345/102 |
| 2009/0303412 | A1* | 12/2009 | Ake et al. | 315/152 |
| 2010/0007600 | A1* | 1/2010 | Deurenberg et al. | 345/102 |
| 2010/0128051 | A1* | 5/2010 | Mizuta et al. | 345/102 |
| 2011/0007055 | A1* | 1/2011 | Wang | 345/211 |

FOREIGN PATENT DOCUMENTS

| | | | |
|---|---|---|---|
| JP | 2003-121929 | A | 4/2003 |
| JP | 2007-294385 | A | 11/2007 |

* cited by examiner

*Primary Examiner* — Adam J Snyder
(74) *Attorney, Agent, or Firm* — Canon USA, Inc. IP Division

(57) ABSTRACT

A selected divided light-emitting region, from a plurality of divided light-emitting regions, emits light in a light emitting unit and adjusts the light emission amount for each of the plurality of divided light-emitting regions based on the light emission amount detected by a detection unit.

16 Claims, 11 Drawing Sheets

LIGHT EMITTING UNIT

IMAGE DATA

FIG. 10

| DIVIDED LIGHT-EMITTING REGION TO BE ADJUSTED | PROGRESS INFORMATION DISPLAY AREA CORRESPONDING TO DIVIDED LIGHT EMITTING REGION TO BE ADJUSTED |
|---|---|
| D1 | D12 |
| D2 | D12 |
| D3 | D9 |
| D4 | D9 |
| D5 | D12 |
| D6 | D12 |
| D7 | D9 |
| D8 | D9 |
| D9 | D4 |
| D10 | D4 |
| D11 | D1 |
| D12 | D1 |

LIGHT EMITTING UNIT

IMAGE DATA

IMAGE DISPLAY APPARATUS WITH A PLURALITY OF DIVIDED LIGHT-EMITTING REGIONS AND METHOD FOR CONTROLLING THEREOF

BACKGROUND OF THE INVENTION

1. Field of the Invention

The present invention relates to an image display apparatus including a light emitting unit with a plurality of divided light-emitting regions and a method for controlling thereof.

2. Description of the Related Art

Recently, light-emitting diodes (LEDs) have been used as a light emitting element for a backlight of an image display apparatus since LEDs have long life and consume less power. A light emission amount of an LED can be controlled by repeating ON/OFF of current passing through the LED at a constant frequency to change an ON/OFF ratio and a current value passing through the LED.

The LED has a property that a light-emitting characteristic differs according to an individual difference, aged deterioration, and the like. In a case where a plurality of LEDs are used as a light source of the image display apparatus, since the light emission amount differs between each LED, the light emission amount varies between the LEDs. To solve the above problem, Japanese Patent Laid-open Publication No. 2007-294385 discusses a backlight device capable of adjusting variation in the light emission amount per a chip including a plurality of LEDs. A process for adjusting the light emission amount of the light emitting element to a predetermined value in the backlight device and the like is hereinafter referred to as "light emission adjusting process".

In a liquid-crystal projector, a fan works to remove heat in the housing of the projector after power to the lamp of the projector is turned off. Japanese Patent Laid-open Publication No. 2003-121929 discusses a technique that progress until the fan is shutdown is shown to a user by changing a luminescent color or a light-emitting state of the LED to indicate how long it takes before the fan is shutdown after power to the lamp is turned off.

When the light emission adjusting process is performed, the light emitting element of the backlight is arbitrarily lit up to adjust the light emission amount of the light emitting element of the backlight. The light emitting element for adjusting the light emission amount is lit up as needed, but the light emitting element other than those unrelated to the adjustment of the light emitting element may not be lit up. The light emission amount can be adjusted more accurately if the light emission element unrelated to the adjustment of the light emission element is not lit up in a case where only the light emission amount of the light emitting element to be adjusted is required to be detected.

Therefore, only a part of the light emitting elements may be lit up in the backlight during the light emission adjusting process, so that a normal image that requires luminescent colors of red (R), green (G), and blue (B) sometimes cannot be displayed. During the light emission adjusting process of the back light, if the light emitting element to be adjusted is sequentially changed, a light-on area and a light-off area of the light emitting elements change over time. Therefore, in a case where an image representing progress of the light emission adjusting process (e.g., how far the light emission adjusting process goes) is displayed, an image of the area in which the back light is lit out may not be recognized. To provide the progress by using the LED in a manner as discussed in Japanese Patent Laid-open Publication No. 2003-121929, the LED is required to be provided at a position other than the display screen as well as a correspondence between a light emission pattern of the LED and the progress of the light emission adjusting process needs to be recorded, so that the user cannot grasp information of the progress and the like with ease.

SUMMARY OF THE INVENTION

One aspect of the present invention is directed to enabling a user to grasp the information via a display with ease during the light emission adjusting process of the backlight.

According to an aspect of the present invention, an image display apparatus includes a light emitting unit including a plurality of divided light-emitting regions, a detection unit configured to detect a light emission amount for each divided light-emitting region, a light emission control unit configured to cause, from among the plurality of divided light-emitting regions, a selected divided light-emitting region to emit light and to cause non-selected divided light-emitting regions to stop emitting light in response to an adjusting instruction of a light emission amount, an adjustment unit configured, based on the detection result of the light emission amount of the selected divided light-emitting region detected by the detection unit, to adjust the light emission amount of the selected divided light-emitting region, and a display control unit configured to perform control to display predetermined information on a display area of a display unit corresponding to the selected divided light-emitting region in response to the adjusting instruction of the light emission amount.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 10 is a table indicating progress information display areas corresponding to the divided light-emitting regions to be adjusted.

DESCRIPTION OF THE EMBODIMENTS

Various exemplary embodiments, features, and aspects of the invention will be described in detail below with reference to the drawings.

Figure 1:
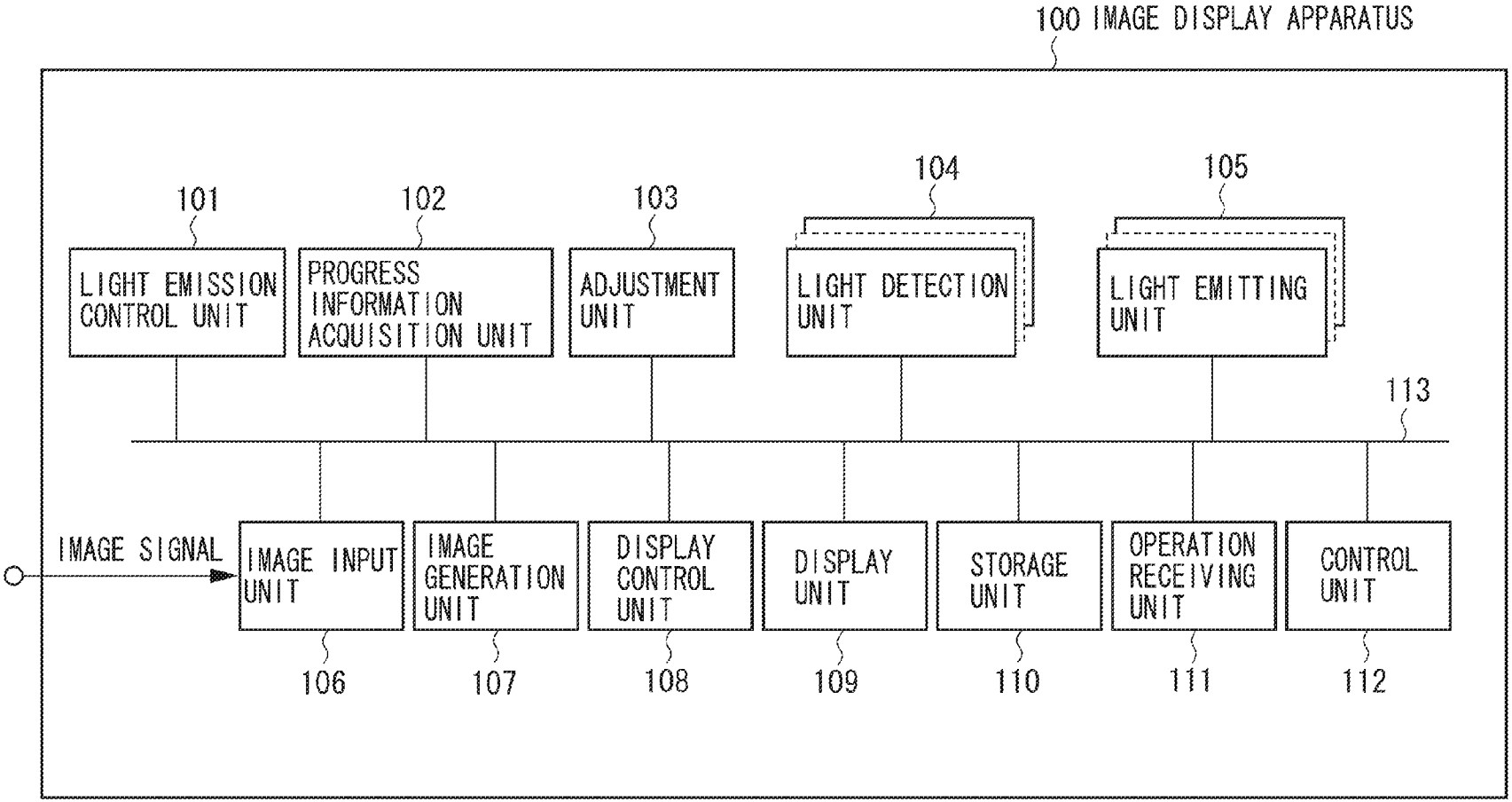
FIG. 1 is a block diagram illustrating an image display apparatus.

FIG. 1 is a block diagram of an image display apparatus 100 of a first exemplary embodiment. The image display apparatus 100 includes a light emission control unit 101, a progress information acquisition unit 102, an adjustment unit 103, a light detection unit 104, a light emitting unit 105, an image input unit 106, an image generation unit 107, a display control unit 108, a display unit 109, a storage unit 110, an operation receiving unit 111, and a control unit 112, which are connected via a bus 113. An operation of the image display apparatus 100 having the above described configuration is described below.

Figure 2:
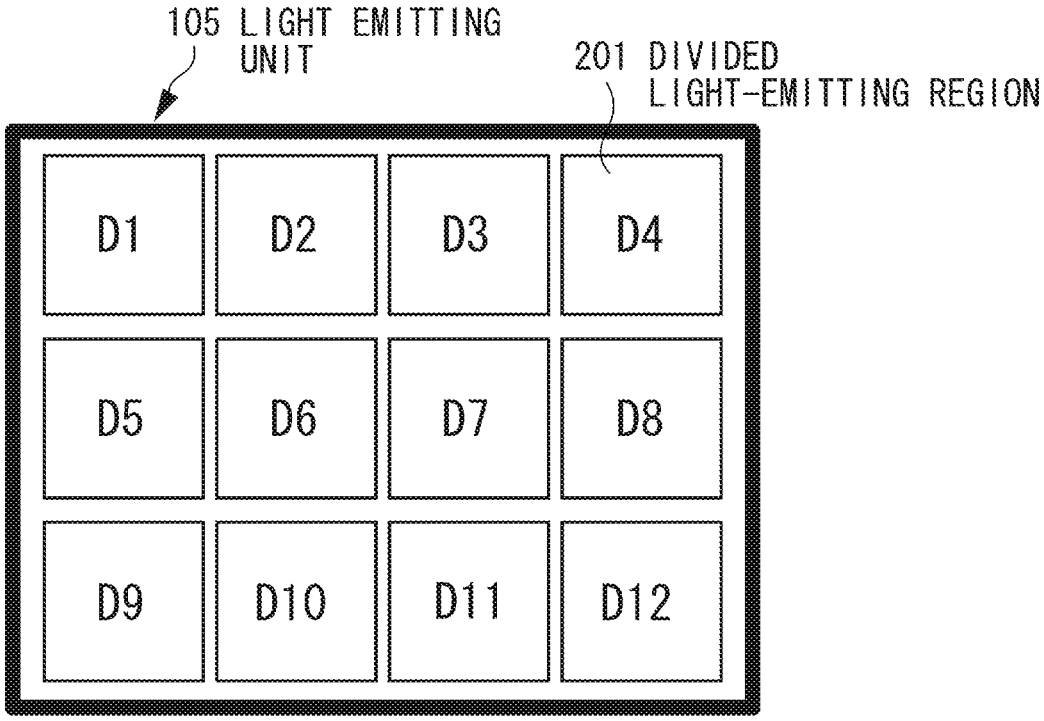
FIG. 2 is a schematic view illustrating a light emitting unit.

The light emission control unit 101 controls a light-on and a light-off of the light emitting unit 105 and further controls a light emission amount of the light emitting unit 105. The light emitting unit 105 is positioned on a back surface of the display unit 109 to be used as a backlight of the display unit 109. The light emitting unit 105 irradiates a display area of the display unit 109 corresponding to the light emitting unit 105 with light. As illustrated in FIG. 2, the light emitting unit 105 includes a plurality of divided light-emitting regions 201. Each of the divided light-emitting regions can emit light.

The light emission control unit 101 can perform control to adjust the light emission amount per each divided light-emitting region. The light emission control unit 101 determines an order of adjustment of the light emission amount of each of the divided light-emitting regions of the light emitting unit 105. The light emission control unit 101 also performs control to store the order of the divided light-emitting regions of which light emission quantities are adjusted and to cause the storage unit 110 to store the divided light-emitting regions after the adjustment (i.e., after completion of adjustment) of the light emission quantities.

In the present exemplary embodiment, the light emitting unit 105 includes the total twelve divided light-emitting regions 201 (D1 through D12), e.g., four in a horizontal direction multiplied by three in a vertical direction as illustrated in FIG. 2. However, the divided light-emitting regions 201 is not limited to the above, and the light emitting unit 105 may only include a plurality of divided light-emitting regions.

The progress information acquisition unit 102 acquires progress information of the light emission adjusting process performed by the light emitting unit 105. The progress information indicates a ratio of the divided light-emitting regions of which adjustment of the light emission amount is completed among the plurality of divided light-emitting regions 201 (i.e., D1 through D12) of the light emitting unit 105. A description of the progress information and a specific method for calculating the progress information is described below.

The adjustment unit 103 calculates a correction value such that the light emission amount of the light emitting unit 105 becomes a predetermined value based on a detection result of the light detection unit 104 that detects the light emission amount of the light emitting unit 105. The light detection unit 104 detects the light emission amount of each divided light-emitting region constituting the light emitting unit 105. The image input unit 106 receives image data input from an external image input apparatus (not illustrated) connected to the image display apparatus 100. The image generation unit 107 generates image data to be displayed on the display unit 109.

The display control unit 108 performs control to display image data received by the image input unit 106, image data generated by the image generation unit 107, and image data stored in the storage unit 110 on the display unit 109. The display unit 109, including liquid crystal panel and the like, displays the image data by changing light transmittance from the light emitting unit 105. The storage unit 110 stores the order of the divided light-emitting regions of which light emission quantities determined by the light emission control unit 101 are adjusted, the divided light-emitting regions of which light emission quantities are adjusted, image data, a program for controlling the image display apparatus 100, and the like.

The operation receiving unit 111 receives an operation instruction using a keyboard, mouse, and the like (not illustrated) from the user. The control unit 112, including a central processing unit (CPU) and the like, can control each block within the image display apparatus 100 by executing the program stored in the storage unit 110.

Figure 3:
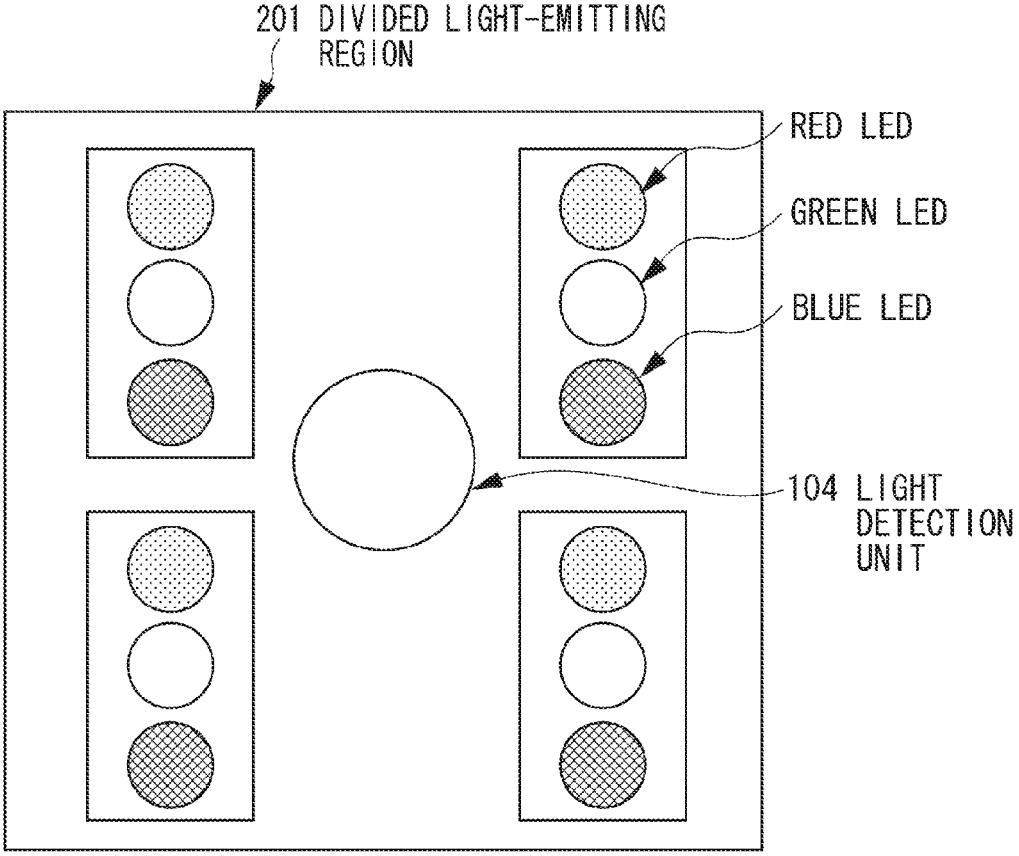
FIG. 3 is a schematic view illustrating a configuration of a divided light-emitting region.

FIG. 3 illustrates a configuration of the divided light-emitting region. In the present exemplary embodiment, each divided light-emitting region 201 of the light emitting unit 105 is arranged with four sets of light emitting elements, each including three colors (RGB) of LEDs, more specifically, each including one red (R) LED, one green (G) LED, and one blue (B) LED. The configuration of each divided light-emitting region 201 is not limited to the above configuration. For example, each divided light-emitting region 201 may include one set of RGB LEDs or may include a plurality of sets of light emitting elements composed of total of four light emitting elements as a set, more specifically, composed of one red LED, two green LEDs, and one blue LED. The divided light-emitting region may include white LEDs instead of RGB LEDs.

In the present exemplary embodiment, as illustrated in FIG. 3, one light detection unit 104 is provided to each of the plurality of divided light-emitting regions 201 (i.e., D1 through D12) of the light emitting unit 105 and can detect the light emission amount of each divided light-emitting region 201 (i.e., each of D1 through D12). The light detection unit 104 is a RGB sensor and is positioned at a position at which the light emission amount of each of R, G, and B of the divided light-emitting region 201 can be measured.

An operation of the image display apparatus 100 in the present exemplary embodiment is described below with reference to a flow chart of FIG. 4.

In step S401, as a result of the operation receiving unit 111 receiving an adjusting instruction of the light emission amount from the light emitting unit 105, the light emission control unit 101 receives a flag F indicating a start of the light emission adjusting process from the control unit 112. The light emission adjusting process of the light emitting unit 105 may be performed in response to the result that the operation receiving unit 111 receives the adjusting instruction of the light emission amount instructed by the user or may perform the process periodically. The processing illustrated in FIG. 4 is repeated every time the light emission adjusting process of the light emitting unit 105 is performed. In the light emission adjusting process of the light emitting unit 105 in the present exemplary embodiment, the adjustment of the light emission amount is to be performed sequentially from the divided light-emitting region 201 (D1) to the divided light-emitting region 201 (D12).

Subsequently, the progress information acquisition unit 102 acquires progress information. Based on information of the divided light-emitting region where the adjustment of the light emission amount is completed after the light emission control unit 101 receives the flag F, the progress information acquisition unit 102 acquires progress information. The progress information indicates a ratio of the divided light-emitting regions of which adjustment of the light emission quantities is completed among the plurality of divided light-emitting regions of the light emitting unit 105. The progress information can be acquired based on the number of divided light-emitting regions of the light emitting unit 105 and the number of divided light-emitting regions of which adjustment of the light emission quantities is completed. For example, the progress information includes degree of progress obtained by the following equation using the number m of the divided light-emitting regions of the light emitting unit 105 and the number n of the divided light-emitting regions of which adjustment of the light emission amount is completed.

$$\text{Degree of progress [\%]}=n/m\times 100 \quad \text{(Equation 1)}$$

The number of divided light-emitting regions of the light emitting unit 105 and the number of divided light-emitting regions of which adjustment of the light emission quantities is completed are stored in the storage unit 110. In the present exemplary embodiment, as illustrated in FIG. 2, since the number of the divided light-emitting regions is twelve, m equals to twelve (n=12). The light emission amount is adjusted sequentially from the divided light-emitting region 201 (D1). The number of divided light-emitting regions of which adjustment of the light emission quantities is completed is six in a period after the adjustment of the light emission amount of the divided light-emitting region 201 (D6) is completed and before the adjustment of the light emission amount of the divided light-emitting region 201 (D7) is completed. During the period, in a case where n equals to six (n=6), the degree of progress is 50%. Alternatively, in the above period, n may be seven (n=7) by adding the divided light-emitting region 201 (D7) in the process of adjustment of the light emission amount thereof to the number of divided light-emitting regions of which adjustment of the light emission quantities is completed. The progress information acquisition unit 102 transmits thus acquired progress information to the image generation unit 107.

In step S403, the image generation unit 107 generates image data indicating the progress information acquired from the progress information acquisition unit 102. The image generation unit 107 acquires information of the divided light-emitting region (to be adjusted) of which adjustment of the light emission amount is executed and generates image data in which the progress information is displayed on the display area of the display unit corresponding to the divided light-emitting region. In step S404, the display control unit 108 performs control to output the image data generated in step S403 to the display unit 109.

Figure 5A:
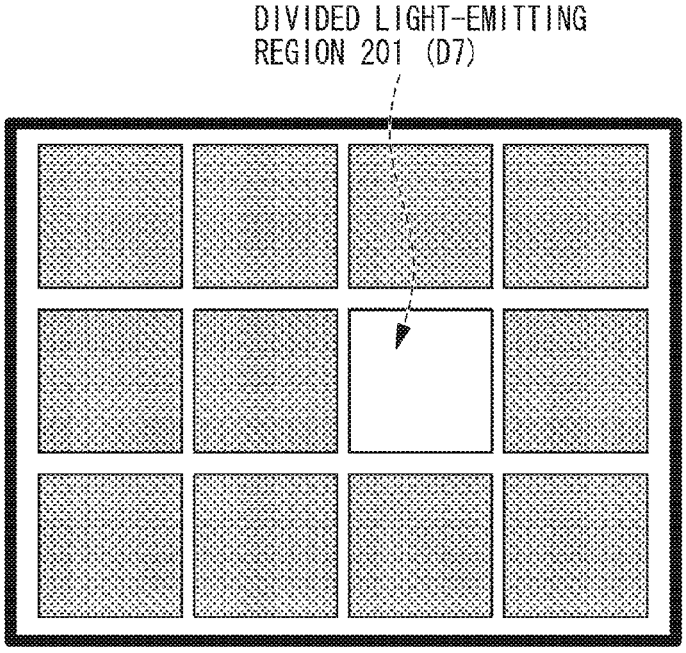
FIGS. 5A and 5B are schematic views of a divided light-emitting region to be adjusted and image data indicating progress information, respectively, in the first exemplary embodiment.
Figure 5B:
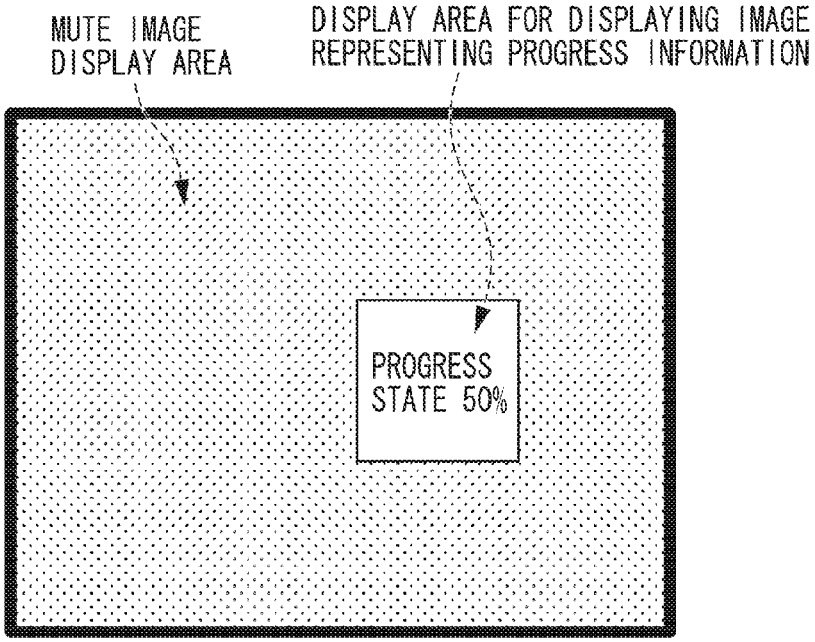

FIGS. 5A and 5B illustrate examples of the divided light-emitting region to be adjusted 201 (D7) and image data displayed on the display unit 109 after generated by the image generation unit 107, respectively. The image generation unit 107 generates an image representing the progress information on the displaying area of the display unit 109 corresponding to the divided light-emitting region to be adjusted, whereas the image generation unit 107 generates a mute (black) image on the area other than the above.

In step S405, the light emission control unit 101 subsequently lights up the light emitting element of the divided light-emitting region to be adjusted, whereas the light emission control unit 101 stops the lighting of the light emitting elements of the divided light-emitting regions other than the divided light-emitting region to be adjusted. In step S406, the light detection unit 104 detects the light emission amount of the divided light-emitting region to be adjusted. In step S407, the adjustment unit 103 calculates a correction value such that the light emission amount of the divided light-emitting region becomes a predetermined value based on the detection result detected by the light detection unit 104, and the light emission control unit 101 performs control to adjust the light emission amount of the divided light-emitting region based on the calculated correction value.

Figure 6:
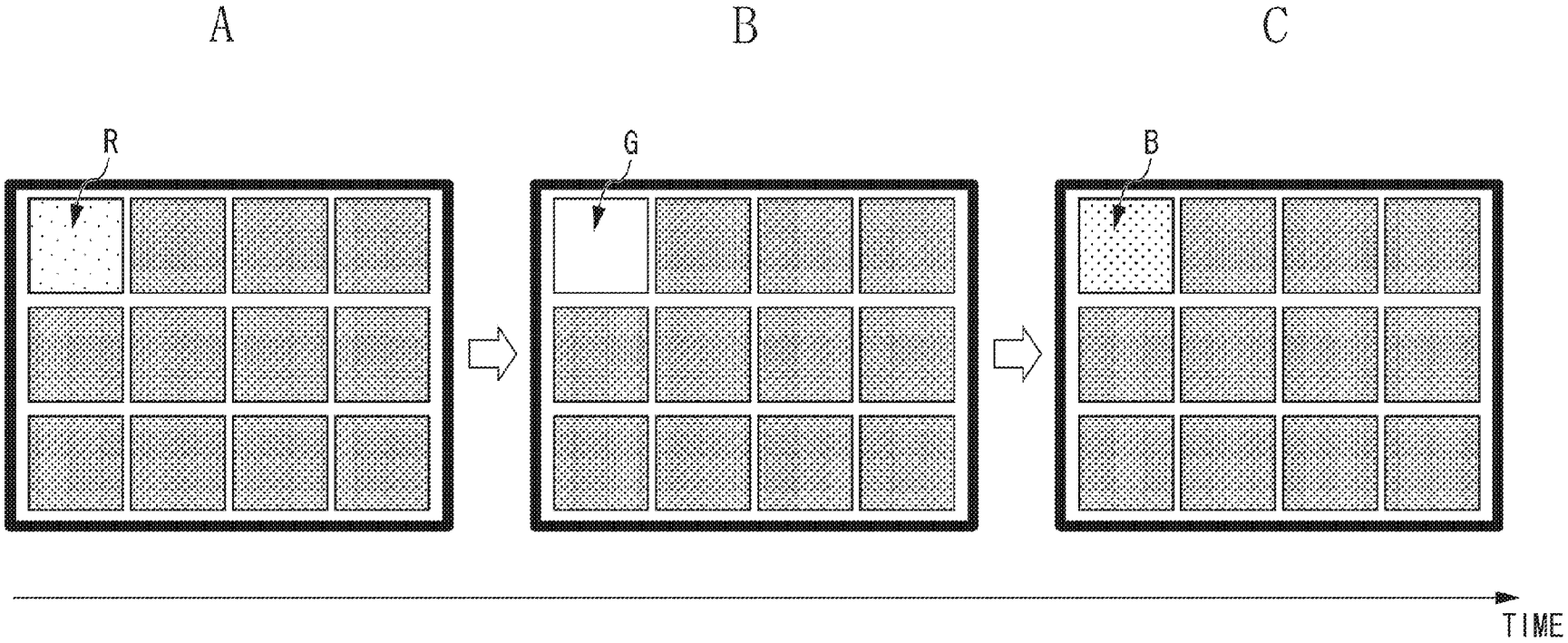
FIG. 6 is a schematic view illustrating a light-on order of the divided light-emitting regions to be adjusted.

In a case where the light emitting elements R, G, and B are provided on the divided light-emitting region, as illustrated in FIG. 6, in step S405, the light emitting element R, the light emitting element G, and the light emitting element B within the divided light-emitting region to be adjusted 201 (D1) are sequentially lit up. In step S406, the light detection unit 104 detects the light emission amount of the light emitting element of each color. In step S407, the adjustment unit 103 calculates the correction value thereof. After the adjustment of the light emission amount is completed with respect to each of the light emitting element R, the light emitting element G, and the light emitting element B within the divided light-emitting region, the adjustment unit 103 adjusts the light emission amount of the divided light-emitting region 201 (D2) as the next region to be adjusted and the adjustment of the light emission amount is performed sequentially with respect to the following divided light-emitting regions.

In step S408, the light emission control unit 101 determines whether the adjustment of the light emission amount of the divided light-emitting region to be adjusted is completed. In a case where the adjustment is completed (YES in step S408), the processing proceeds to step S409.I In a case where the adjustment is not completed (NO in step S408), the processing returns to step S405. In step S409, the light emission control unit 101 determines whether the adjustment of the light emission amount is completed with respect to all the divided light-emitting regions 201 of the light emitting unit 105. In a case where there is a divided light-emitting region of which adjustment of the light emission amount is not completed yet (NO in step S409), the light emission control unit 101 changes the divided light-emitting region to be adjusted to the divided light-emitting region of which adjustment of the light emission amount is not completed yet and repeats the processing on and after step S402 until the adjustment of the light emission amount is completed with respect to all the divided light-emitting regions 201. As described above, the light emission quantities of all the divided light-emitting regions are adjusted to be a predetermined value. Accordingly, the variation in the light emission quantities thereof is adjusted.

In response to determination of the light emission control unit 101 in which the adjustment of the light emission amount is completed with respect to all the divided light-emitting regions 201 (YES in step S409), in step S411, the image generation unit 107 generates image data indicating the completion of the light emission adjusting process of the light emitting unit 105. The display control unit 108 performs control such that thus generated image data is displayed on the display unit 109. The image data representing the completion of the light emission adjusting process is image data that displays a message indicating that the light emission adjusting process is completed on the display area of the display unit corresponding to the divided light-emitting region of which adjustment of the light emission amount is performed lastly. When the image data indicating the completion of the light emission adjusting process is displayed, at least the light emitting element of the divided light-emitting region of which light emission amount is adjusted lastly in the light emitting unit 105 is lit up. Alternatively, the image data representing the completion of the light emission adjusting process may be an image data such that the image data is displayed on a display area corresponding to a plurality of divided light-emitting regions of the light emitting unit 105. In this case, the light emitting elements of the plurality of divided light-emitting regions are lit up. Accordingly, the light emission adjusting process of the light emitting unit 105 ends.

Figure 4:
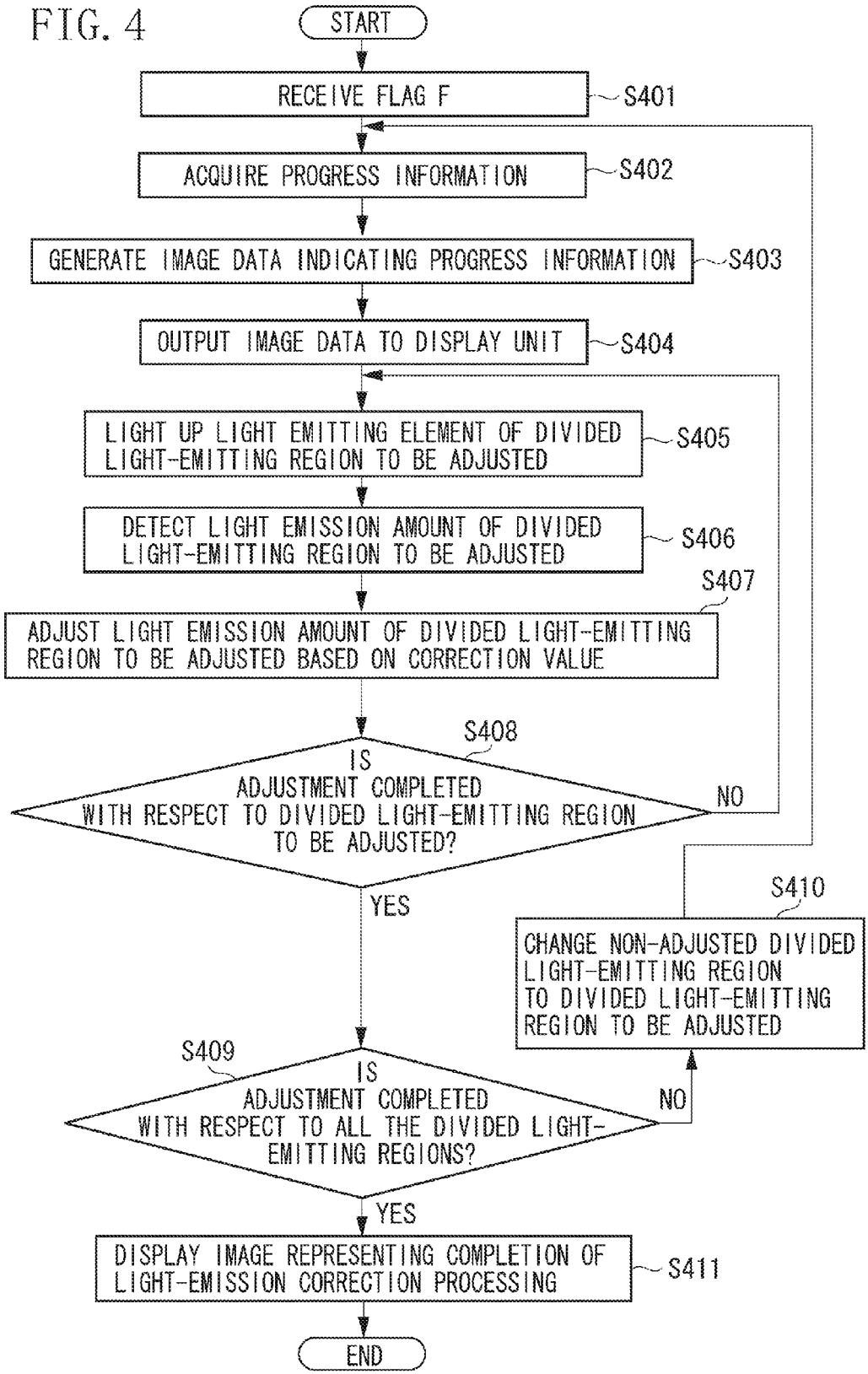
FIG. 4 is a flow chart illustrating an operation of the image display apparatus in a first exemplary embodiment.
Figure 7:
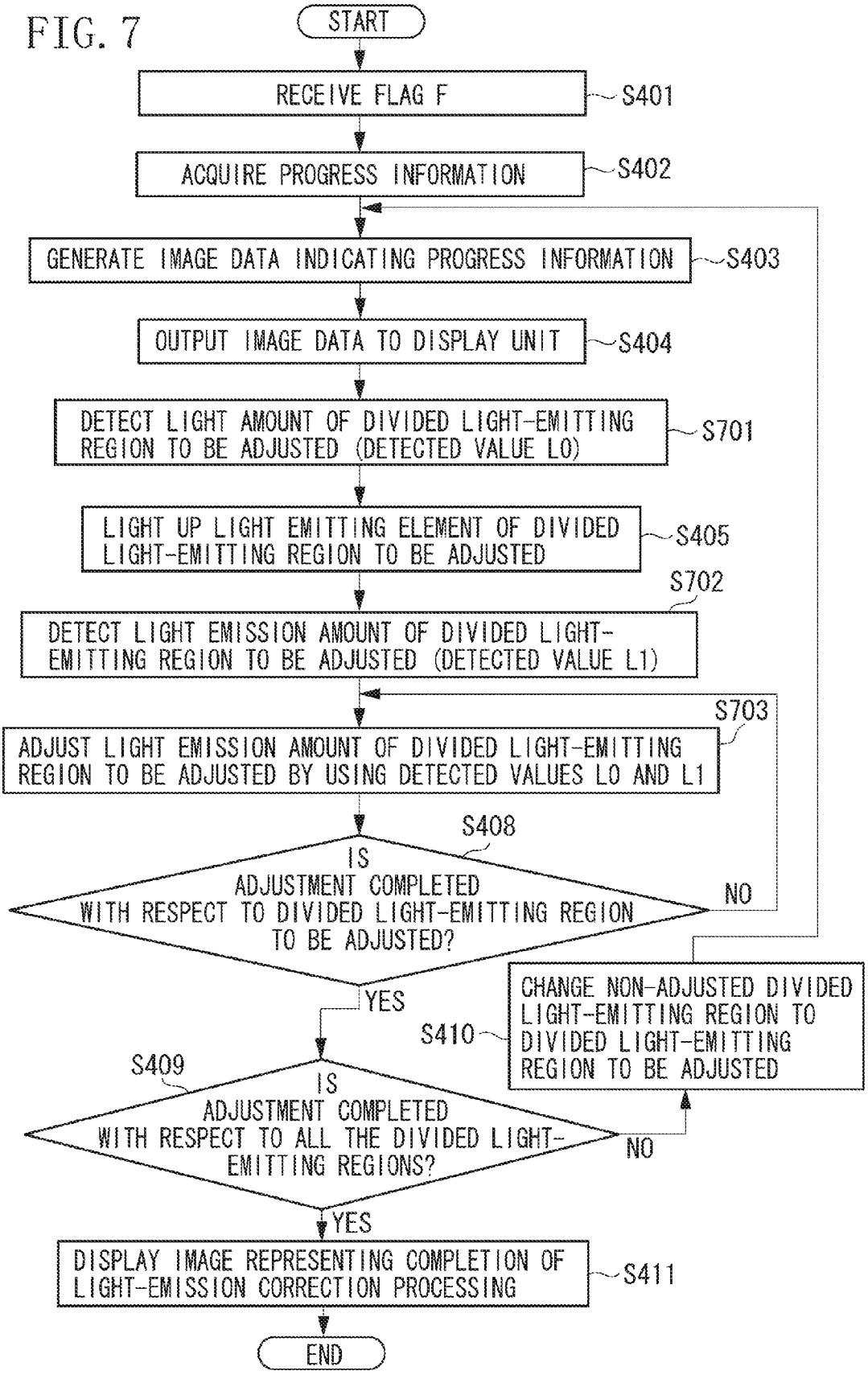
FIG. 7 is a flow chart illustrating the operation of the image display apparatus in consideration with an effect of external light.

In the present exemplary embodiment, while the light detection unit 104 causes the display unit 109 to display image data and causes the light emitting element of the divided light-emitting region to be adjusted to be lit on, in step S406 of FIG. 4, the light detection unit 104 detects the light emission amount thereof. In a state that the image data is displayed on the display unit 109, since the display unit 109 changes a light transmittance to cause the light from the light emitting unit 105 to transmit the display unit 109, external light of the image display apparatus 100 also transmits the display unit 109. Therefore, the transmitted light is detected by the light detection unit 104. Accordingly, when the light detection unit 104 detects the light emission amount of the divided light-emitting region, the light detection unit 104 detects more light emission amount than a case where no image data is displayed (or the mute (black) image is displayed) on the display unit 109 by an amount of the external light of the image display apparatus 100 that passes through the display unit 109. Therefore, to avoid an effect of the external light of the image display apparatus 100 that passes through the display unit 109, the light emission adjusting process may be performed according to the flow as illustrated in FIG. 7. The processing steps having the reference symbols identical to the processing steps of FIG. 4 are steps in each of which the processing similar to the corresponding step of FIG. 4 is performed.

In step S404, after the display control unit 108 outputs the image data to the display unit, in step S701, the light detection unit 104 detects the light amount (i.e., detected value L0) of the divided light-emitting region to be adjusted. Accordingly, detected is the light amount of the light detection unit 104 in a state that the display unit 109 is controlled by the display control unit 108 to display the image data representing progress information. At the time, the light emitting elements of all the divided light-emitting regions including the divided light-emitting region to be adjusted are caused to stop light-on.

While the light emission control unit 101 causes only the light emitting element of the divided light-emitting region to be adjusted to light up in step S405, in step S702, the light detection unit 104 detects the light emission amount (i.e., detected value L1) of the divided light-emitting region to be adjusted. In step S703, the adjustment unit 103 calculates the correction value such that the light emission amount of the divided light-emitting region to be adjusted becomes a predetermined value by using a value obtained such that the detected value L0 detected in step S701 is subtracted from the detected value L1 detected in step S702.

By performing the light emission adjusting processing as described above, an effect of the external light of the image display apparatus 100 caused by the display of the image data on the display unit can be suppressed.

Figure 8A:
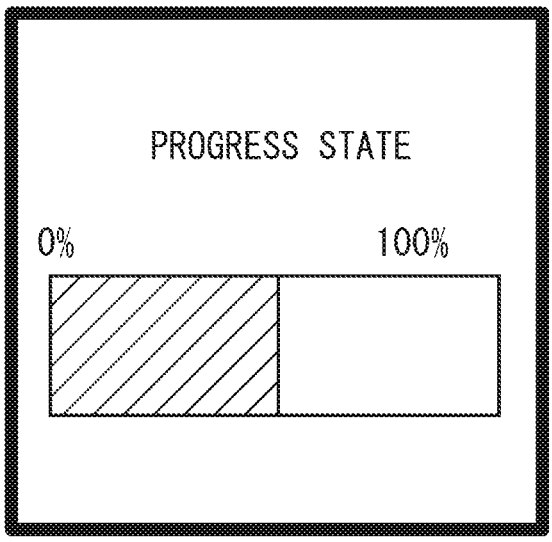
FIGS. 8A and 8B are schematic views illustrating display examples of progress information.
Figure 8B:
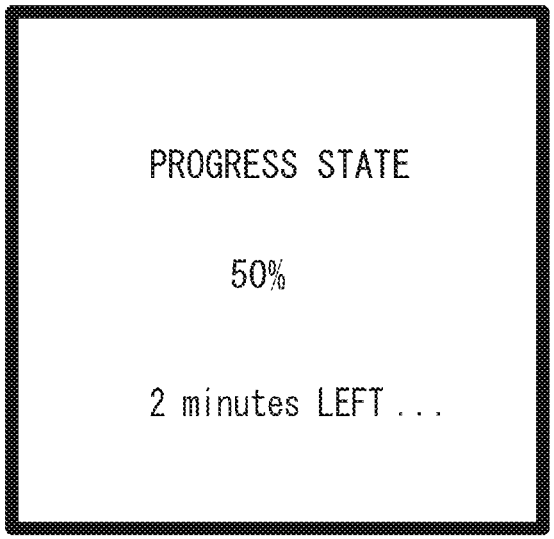

FIGS. 8A and 8B illustrate other display examples of the progress information of a portion of the display area of the display unit corresponding to the divided light-emitting region to be adjusted of the image data generated by the image generation unit 107. In the image data representing the progress information generated by the image generation unit 107, the progress information may be displayed numerically as illustrated in FIG. 5B or, alternatively, may be displayed by using a progress bar as illustrated in FIG. 8A. As illustrated in FIG. 8B, a (roughly estimated) time required until the light emission adjusting processing of the light emitting unit 105, obtainable from the progress information, is completed (i.e., until the adjustment of the light emission quantities of all the divided light-emitting regions of the light emitting unit 105 is completed) may be displayed together. The time required until the light emission adjusting process of the light emitting unit 105 is completed can be calculated such that a time required for adjusting the light emission amount of one divided light-emitting region is multiplied by the number of divided light-emitting regions of which adjustment of the light emission quantities is not completed. Provided that a time at which the adjustment of the divided light-emitting region to be adjusted is started is 0% and a time at which the adjustment thereof is completed is 100%, the degree of progress of the adjustment of the light emission amount of the divided light-emitting region may be displayed together.

The image data generated by the image generation unit 107 may be the image data from which the user can grasp the progress of the light emission adjusting progress of the light emitting unit 105. Not only the progress information of the light emission adjusting process but also information (e.g., abnormality occurrence and the like occurred during the light emission adjusting process) to be informed to the user during the light emission adjusting process may be displayed in the image to be displayed on the display area of the display unit corresponding to the divided light-emitting region to be adjusted.

In the present exemplary embodiment, a case where the light emission amount is adjusted in the order of the light emitting element R, the light emitting element G, and the light emitting element B within each divided light-emitting region. Alternatively, the light emission amount of the light emitting element G and the light emission amount of the light emitting element B in each divided light-emitting region may be adjusted with respect to all the divided light emitting regions after the light emitting element R in each divided light-emitting region is adjusted with respect to all the divided light emitting regions. In the present exemplary embodiment, description is made such that the divided light-emitting region to be adjusted is selected sequentially from the divided light-emitting region 201 (D1) to the divided light-emitting region 201 (D12). However, the selection of the divided light-emitting region to be adjusted is not limited to the above but a random selection thereof may also be employable (e.g., the divided light-emitting region to be adjusted may be selected in the order of D2, D5, D6, . . . ).

As described above, the present exemplary embodiment can present information so that the user can grasp the progress of the light emission adjusting process via display with ease when the light emission adjusting process of the light emitting unit.

Figure 9:
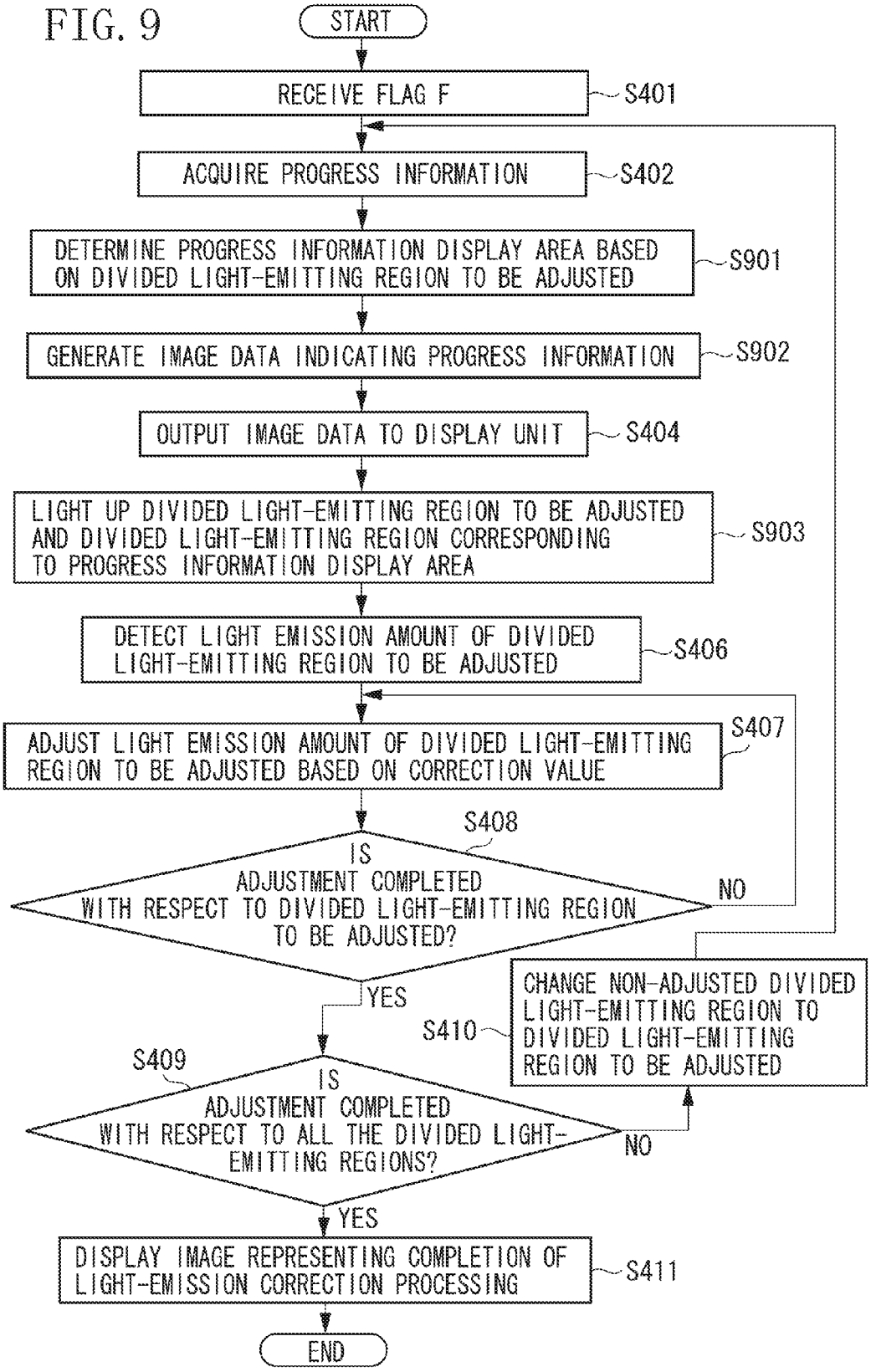
FIG. 9 is a flow chart illustrating an operation of an image display apparatus in a second exemplary embodiment.

A second exemplary embodiment will now be described. The second exemplary embodiment describes a case where progress information of the light emission adjusting process of the light emitting unit 105 is displayed on a display area different from the display area of the display unit corresponding to the divided light-emitting region (to be adjusted) of which adjustment of the light emission amount is performed. In the present exemplary embodiment, a description is made by using the block diagram of the image display apparatus 100 illustrated in FIG. 1 as it is done in the description of the first exemplary embodiment. An operation of the image display apparatus 100 in the present exemplary embodiment is described below with reference to a flow chart of FIG. 9. In FIG. 9, the processing steps provided with the same symbols as the steps in FIG. 4 perform the processing similar to those of FIG. 4.

In step S402, the progress information acquisition unit 102 acquires the progress information. Subsequently, in step S901, the light emission control unit 101 determines a progress information display area based on the divided light-emitting region (to be adjusted) of which adjustment of the light emission amount in the light emitting unit 105 is performed. The progress information display area corresponding to the divided light-emitting region to be adjusted is preliminary determined as illustrated in FIG. 10 and is stored in the storage unit 110 in the form of a table data. For example, in a case where the divided light-emitting region to be adjusted is the divided light-emitting region 201 (D9), the progress information display area is the divided light-emitting region 201 (D4). The progress information display area is desirably positioned at a position away from the divided light-emitting region to be adjusted by a predetermined distance such that an effect becomes less when the light emission amount is detected in the divided light-emitting region to be adjusted. The progress information display area is desirably set to the divided light-emitting region that is not at least neighboring the divided light-emitting region to be adjusted. The light emission control unit 101 transmits the information of the progress information display area together with the information of the divided light-emitting region to be adjusted to the image generation unit 107.

Figure 11A:
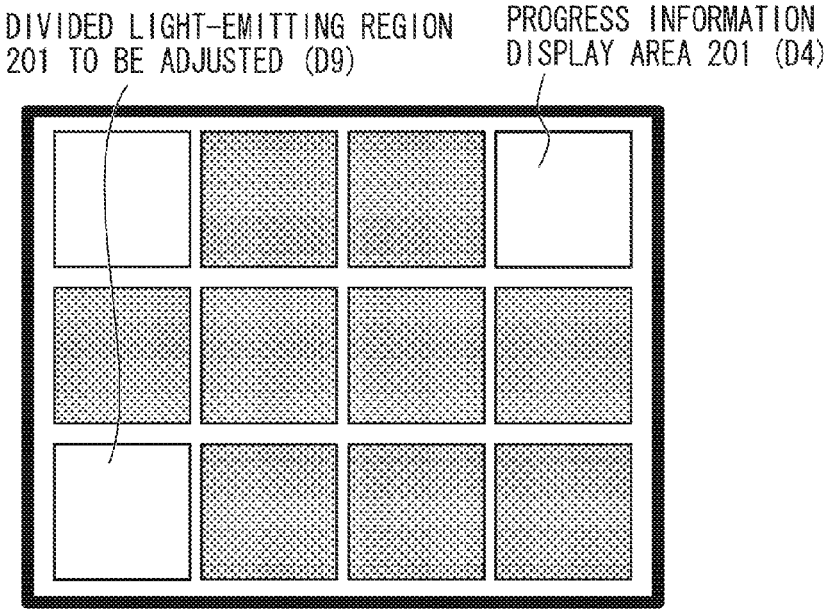
FIGS. 11A and 11B are schematic views of image data indicating the divided light-emitting region to be adjusted and progress information thereof, respectively.
Figure 11B:
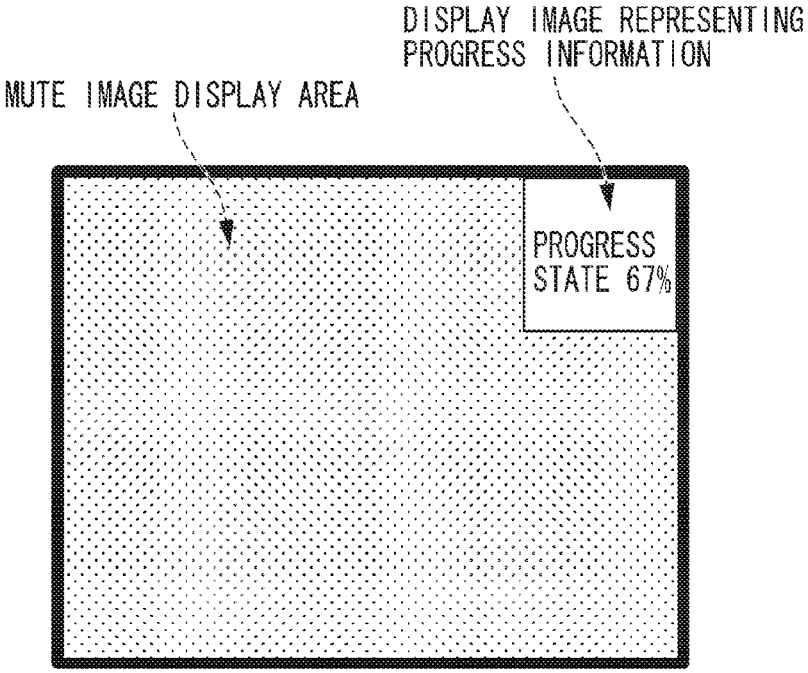

In step S902, the image generation unit 107 acquires the progress information from the progress information acquisition unit 102 to generate the image data representing the progress information. The image generation unit 107 generates an image representing the progress information in the display area of the display unit corresponding to the progress information display area received from the light emission control unit 101 and generates the mute (black) image in the other display area. For example, in a case where the divided light-emitting region to be adjusted is the divided light-emitting region 201 (D9), the degree of progress indicated by the progress information is 67% according to the above described equation 1. FIG. 11A illustrates a specific example of the divided light-emitting region to be adjusted of the light emitting unit 105 and the progress information display area corresponding to the divided light-emitting region. FIG. 11B illustrates a specific example of the image data generated in the image generation unit 107.

In step S404, the display control unit 108 performs control to output the image data generated in step S902 to the display unit 109. In step S903, the light emission control unit 101 causes the light emitting element of the divided light-emitting region to be adjusted and the light emitting element of the progress information display area to light up. In the divided light-emitting region to be adjusted, the adjustment of the light emission amount is performed in a manner similar to the first exemplary embodiment. As described above, while the adjustment of the light emission amount of the divided light-emitting region to be adjusted is performed, the progress information of the light emission adjusting process of the light emitting unit 105 can be displayed on the display area of the display unit corresponding to the progress information display area.

The light emitting element of the progress information display area can performs control the light emission amount so that the light emission does not have an effect on detecting the light emission amount of the divided light-emitting region to be adjusted. The light emission amount of the progress information display area may be preliminary set according to a distance between the divided light-emitting region to be adjusted and the progress information display area. Thus set light emission amount may be stored in the storage unit 110 together with the table of FIG. 10. In FIG. 10, the progress information display areas of the divided light-emitting region 201 (D1) and the divided light-emitting region 201 (D2) are corresponded to the divided light-emitting region 201 (D12) and the area displaying the progress information does not change during the light emission adjusting process of the divided light-emitting region 201 (D1) and the divided light-emitting region 201 (D2). In the first exemplary embodiment, the position of the display area of the progress information changes according to the change of the divided light-emitting region to be adjusted, whereas, in the second exemplary embodiment, the correspondence as shown in FIG. 10 enables controlling of the change in position of the display area of the progress information. In the present exemplary embodiment, the progress information display area is caused to correspond to one divided light-emitting region. However, the progress information display area may be caused to correspond to a plurality of neighboring divided light-emitting regions (e.g., progress information display areas D11 and D12 may correspond to the divided light-emitting region to be adjusted D1). Information to be informed to the user during the light emission adjusting process (i.e., abnormality occurrence and the like occurred during the light emission adjusting process) may be displayed on the display area of the display unit corresponding to the progress information display area instead of the progress information of the light emission adjusting process.

In the present exemplary embodiment, the light emitting unit 105 includes the total twelve divided light-emitting regions, e.g., four in the horizontal direction multiplied by three in the vertical direction, as illustrated in FIG. 2. However, the present invention can be applied to the light emitting unit 105 including a total four divided light-emitting regions 201 (D1 through D4), e.g., two in the horizontal direction multiplied by two in the vertical direction. In a case where the divided light-emitting region 201 (D1) positioned upper left of the light emitting unit 105 is the divided light-emitting region to be adjusted, the divided light-emitting region 201 (D4) positioned in an oblique direction (i.e., lower right direction) with respect to the divided light-emitting region 201 (D1) is set to be the progress information display area. If the light emission amount of the progress information display area can be controlled such that the detection of the light emission amount of the divided light-emitting region to be adjusted is not effected, the progress information display area may be the divided light-emitting region neighboring the divided light-emitting region to be adjusted.

As described above, in the present exemplary embodiment, the progress information of the light emission adjusting process can be displayed on the display unit while an effect on the adjustment of the light emission amount of the divided light-emitting region is suppressed when the light emission adjusting process of the light emitting unit is performed. Accordingly, the progress of the light emission adjusting process can be presented to be grasped by the user with ease.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-088427 filed Apr. 12, 2011, and Japanese Patent Application No. 2012-030884 filed Feb. 15, 2012, each of which is hereby incorporated by reference herein in its entirety.

What is claimed is:

1. An image display apparatus, comprising:

a light emitting unit including a plurality of divided light-emitting regions;

a detection unit configured to detect a light emission amount for each divided light-emitting region;

a light emission control unit configured to cause, from among the plurality of divided light-emitting regions, a selected divided light-emitting region to emit light and to cause non-selected divided light-emitting regions to stop emitting light in response to an adjusting instruction of a light emission amount;

an adjustment unit configured to adjust, based on a detection result of the light emission amount of the selected divided light-emitting region detected by the detection unit, the light emission amount of the selected divided light-emitting region; and a display control unit configured to, in response to the adjusting instruction of the light emission amount, perform control to display progress information that indicates degree of progress of the light emission amount adjustment on a display area of a display unit corresponding to the selected divided light-emitting region.

2. The image display apparatus according to claim 1, wherein, in the selected divided light-emitting region, the light emission control unit is configured to cause the selected divided light-emitting region to stop emitting light and the adjustment unit is configured to adjust the light emission amount of the selected divided light-emitting region by using the detection result of the detection unit in a state that the display control unit displays the progress information on the display unit and the detection result of the detection unit in a state that the light emission control unit causes the selected divided light-emitting region to emit light and the display control unit displays the progress information on the display unit.

3. The image display apparatus according to claim 1, wherein the adjustment unit is configured to adjust the light emission amount of the divided light-emitting region to a predetermined value.

4. The image processing apparatus according to claim 1, wherein the display control unit displays the progress information on the display area of the display unit by using at least one of letters, numbers, or a progress bar.

5. An image display apparatus, comprising:

a light emitting unit including a plurality of divided light-emitting regions;

a detection unit configured to detect a light emission amount for each divided light-emitting region;

a light emission control unit configured, in response to an adjusting instruction of the light emission amount, to cause, from among the plurality of divided light-emitting regions, a selected first divided light-emitting region and a predetermined second divided light-emitting region determined according to a position of the first divided light-emitting region to emit light, and to cause other divided light-emitting regions to stop emitting light;

an adjustment unit configured, based on a detection result of the light emission amount of the first divided light-emission region detected by the detection unit, to adjust the light emission amount of the first divided light-emitting region; and a display control unit configured, in response to an adjusting instruction of the light emission amount, to perform control to display progress information that indicates degree of progress of the light emission amount adjustment on a display area of the display unit corresponding to the second divided light-emitting region, wherein the position of the second divided light-emitting region is determined at a position away from the first divided light-emitting region by at least a predetermined distance.

6. The image display apparatus according to claim 5, wherein the light emission control unit is configured to determine the second divided light-emitting region by using a table in which the first divided light-emitting region is corresponded to the second divided light-emitting region.

7. The image display apparatus according to claim 5, wherein the light emission control unit is configured to perform control such that the light emission amount of the second divided light-emitting region is lower than the light emission amount of the first divided light-emitting region.

8. The image processing apparatus according to claim 5, wherein the display control unit displays the progress information on the display area of the display unit by using at least one of letters, numbers, or a progress bar.

9. A method for controlling an image display apparatus, comprising:

detecting a light emission amount of a plurality of divided light-emitting regions in a light emitting unit;

performing a light emission control such that, from among the plurality of divided light-emitting regions, a selected divided light-emitting region is caused to emit light and non-selected divided light-emitting regions are caused to stop emitting light in response to an adjusting instruction of the light emission amount;

adjusting the light emission amount of the selected divided light-emitting region based on the detection result of the light emission amount of the selected divided light-emitting region thus detected; and performing control to display progress information that indicates degree of progress of the light emission amount adjustment on a display area of a display unit corresponding to the selected divided light-emitting region in response to the adjusting instruction of the light emission amount.

10. The method according to claim 9, wherein, in the selected divided light-emitting region, the selected divided light-emitting region is caused to stop emitting light and adjust the light emission amount of the selected divided light-emitting region based on the detection result in a state that the progress information is displayed and the detection result in a state that the light emission control causes the selected divided light-emitting region to emit light and display progress information on the display area.

11. The method according to claim 9, wherein adjusting the light emission amount of the divided light-emitting region is to a predetermined value.

12. The method according to claim 9, wherein displaying the progress information on the display area is by using at least one of letters, numbers, or a progress bar.

13. A method for controlling an image display apparatus, comprising:

detecting a light emission amount of a plurality of divided light-emitting regions in a light-emitting unit;

performing a light emission control, from among a plurality of divided light-emitting regions, to cause a selected first divided light-emitting region and a predetermined second divided light-emitting region determined according to a position of the first divided light-emitting region to emit light, and to cause other divided light-emitting regions to stop emitting light in response to an adjusting instruction of the light emission amount;

adjusting the light emission amount of the first divided light-emitting region based on the detection result of the light emission amount of the first divided light-emitting region thus detected; and performing control to display progress information that indicates degree of progress of the light emission amount adjustment on a display area of a display unit corresponding to the second divided light-emitting region in response to the adjusting instruction of the light emission amount, wherein the position of the second divided light-emitting region is determined at a position away from the first divided light-emitting region by at least a predetermined distance.

14. The method according to claim 13, wherein the second divided light-emitting region is determined by using a table in which the first divided light-emitting region is corresponded to the second divided light-emitting region.

15. The method according to claim 13, wherein control is performed such that the light emission amount of the second divided light-emitting region is lower than the light emission amount of the first divided light-emitting region.

16. The method according to claim 13, wherein displaying the progress information on the display area is by using at least one of letters, numbers, or a progress bar.

* * * * *